United States Patent [19]

Baron et al.

[11] 4,309,190

[45] Jan. 5, 1982

[54] PROCESS OF PRODUCING COAL BRIQUETTES FOR GASIFICATION OR DEVOLATILIZATION

[75] Inventors: Gerhard Baron, Hofheim; Dieter Sauter, Nidderau; Wolfgang Sindel, Frankfurt am Main, all of Fed. Rep. of Germany

[73] Assignee: Metallgesellschaft AG, Frankfurt, Fed. Rep. of Germany

[21] Appl. No.: 193,994

[22] Filed: Oct. 6, 1980

[30] Foreign Application Priority Data

Oct. 11, 1979 [DE] Fed. Rep. of Germany ..... 2941301

[51] Int. Cl.[3] ..... C10L 5/48; C10L 5/12; C10L 5/16

[52] U.S. Cl. ..... 44/16 R; 44/1 A; 44/23

[58] Field of Search ..... 44/1 A, 10 R, 16 R, 44/19, 23

[56] References Cited

U.S. PATENT DOCUMENTS

| | | | |
|---|---|---|---|
| 2,819,155 | 1/1958 | Eisenhut et al. | 44/19 |
| 2,907,645 | 10/1959 | Hartmann | 44/16 R |
| 4,002,534 | 1/1977 | Rammler et al. | 44/10 C |
| 4,078,902 | 3/1978 | Olson | 44/10 C |
| 4,239,500 | 12/1980 | Ratenburg | 44/10 C |

*Primary Examiner*—Carl F. Dees

*Attorney, Agent, or Firm*—Sprung, Felfe, Horn, Lynch & Kramer

[57] ABSTRACT

Briquettes made of mainly coal are described to which there has been added 10 to 30% by weight of ash (other than ash which is contained in the coal normally). The briquettes formed from such a mixture have strength which permits them to be subjected to gasification or carbonization in a fixed bed. Also described is a method for forming the briquettes.

5 Claims, No Drawings

PROCESS OF PRODUCING COAL BRIQUETTES FOR GASIFICATION OR DEVOLATILIZATION

This invention relates to a process of producing coal briquettes to be gasified or devolatilized in a fixed fuel bed. The coals which can be employed include also lignite.

The gasification is effected in a known process under a pressure between 5 and 150 bars by a treatment with gasifying agents which contain free oxygen, water vapor and/or carbon dioxide. The fuel in the form of a fixed bed moves slowly downwardly in a fixed bed, through which the gasifying agents are passed from below. The incombustible mineral constituents of the fuel are withdrawn below the fixed bed as solid ash or liquid slag.

The gasification or granular coal in a fixed bed is known and has been described, e.g., in Ullmanns Enzyklopädie der technischen Chemie, 4th edition (1977), on pages 383 to 386 of volume 14. Details of the gasifying process in which the ash remains solid are apparent from U.S. Pat. Nos. 3,540,867 and 3,854,895 and German Offenlegungsschrift No. 2,201,278. In addition to these publications there are numerous further publications explaining the known Lurgi process of gasifying coal in a fixed bed. A modified process involving a withdrawal of liquid slag has been described in British Patent Specifications Nos. 1,507,905; 1,508,671 and 1,512,677.

The devolatilization of briquettes by a treatment without hot scavenging gas is known from German Offenlegungsschrift No. 2,141,876 and the corresponding U.S. Pat. No. 4,002,534.

It is an object of the invention to provide a simple process of producing coal briquettes which can well be used in a coal-gasifying process or in a devolatilizing shaft reactor. This is accomplished in that a mixture to be briquetted is made, which has a particle size below 1 mm and contains mainly coal and about 10 to 30% by weight of ash and said mixture is compacted to form briquettes. The abovementioned ash contents does not include the ash which is contained in the coal to be briquetted. Preferably the mixture contains about 75 to 90 weight percent of coal. Without an addition of a binder, the briquettes which consist of very fine-grained material have a strength which permits them to be subjected to gasification or carbonization in a fixed bed.

The ash required for the mixture to be briquetted is preferably produced by a combustion of coal. It may consist of ash which becomes available as a result of the gasification of coal and which is recycled for the production of briquettes for use in the same gasifying process. In a fixed bed gasification ash containing residual carbon is always subjected to combustion before its removal from the gasification reactor. Ash from another source can also be used, particularly during the start-up of coal-gasifying plant but also quite in general. Such ash from another source may be obtained, e.g., by dry dust collection from the exhaust gases of a coal-fired power plant, e.g., in an electrostatic precipitator. Such extraneous ash usually has the required small particle size, below 1 mm and preferably below 0.2 mm. The ash content of the mixture to be briquetted may generally consist of inert incompressible solids which permit an escape of air from the compact as the briquettes are shaped in the briquetting press. Without the ash content, the coal briquettes contain so many air pockets that they are not strong enough.

The mix to be briquetted is compacted at temperatures at which the coal is not transformed to a plastic state. The briquetting temperatures which can be used in the process lie suitably in the range of about 20° to 100° C.

The mix to be briquetted may also contain 0.5 to 5% by weight of tar or pitch even though these substances are not required as a binder. Owing to their tar or pitch content, the briquettes are sufficiently resistant to water so that they can be stored in the open air and can be exposed to any weather without difficulty.

To provide a mix to be briquetted which is as fine-grained as possible, the mix is suitably ground to reduce its particle size below 0.2 mm. At least 30% by weight of the mix to be briquetted should have a particle size below 0.06 mm and at least 50% by weight a particle size below 0.1 mm. The components of the mix to be briquetted are suitably ground jointly because this will also contribute to the desired mixing. It is also preferable to add any tar or pitch before the grinding to the mix to be briquetted.

The water content of the coal to be used in the mix to be briquetted should not exceed 20% by weight because an excessive water content of the finished briquette may adversely affect its strength at the elevated temperatures used during the gasifying or devolatilizing step. The coal should first be dried when it has been supplied with a higher water content.

The briquettes may be shaped in suitable presses, which are known per se. Such presses include, e.g., the double-roll press, the ring roller press or an extruder. For a production of briquettes having adequate strength, the maximum pressure applied to shape the briquettes should be at least 750 kg/cm$^2$. The briquettes will generally have a volume of about 5 to 50 cm$^3$.

EXAMPLE 1

Hard lignite was dried to a water content of about 14% by weight and incorporated in a mix which consisted of 80% by weight of hard lignite, 20% by weight of ash, obtained by the pressure gasification of coal and 1% by weight of dust-containing tar also obtained by the pressure gasification of coal. The mix was ground in a ball mill so that the particle size was lower than 0.1 mm and the fraction having a particle size below 0.06 mm amounted to 60%. That fine-grained mix to be briquetted was shaped to pillow-adapted briquettes having a volume of 10 cm$^3$ in a double-roll press, which applied a maximum shaping pressure of 1000 kg/cm$^2$. Without being dried, the briquettes were fed to a known Lurgi pressure gasifier and permitted a trouble-free gasifying operation in the experimental reactor.

EXAMPLE 2

The fine-grained fraction below 0.2 mm of the lignite used in Example 1, was mixed with ash obtained by the gasifying operation of Example 1. The ash was previously ground to a particle size below 0.1 mm. No grinding of the lignite was required. Without an addition of tar, a mix consisting of 83% by weight of lignite and 17% by weight of ash was made and was then briquetted as in Example 1. A trouble-free experimental operation of the Lurgi pressure gasifier for coal was again performed.

EXAMPLE 3

An only weakly caking long-flaming gas coal having a water content of 8% by weight was ground to a particle size below 0.2 mm. A mix consisting of 80% by weight of coal and 20% by weight of ash was shaped as in Example 1 to form pillow-shaped briquettes having a volume of 20 $cm^3$. The ash which was used was obtained in the electrostatic precipitator employed to purify the flue gas from a coal-fired power plant. The fraction of the ash having a particle size below 0.06 mm amounted to 80%. These briquettes too met the requirements for the pressure gasification of coal.

What is claimed is:

1. A process of producing coal briquettes to be gasified or devolatilized in a fixed fuel bed which comprises adding 10 to 30 percent by weight of ash to coal and forming a mixture therefrom, said mixture having a particle size below 0.2 mm, said coal containing water not in excess of 20 percent by weight, briquetting said mixture at a temperature in the range of 20° to 100° C. by applying a pressure of at least 750 $kg/cm^2$.

2. A process according to claim 1, wherein at least 30% by weight of the mixture to be briquetted has a particle size below 0.06 mm and at least 50% by weight of the mixture has a particle size below 0.1 mm.

3. A process according to claim 1, wherein the mixture to be briquetted contains 0.5 to 5% by weight of tar or pitch.

4. A process according to claim 1, wherein the components of the mixture to be briquetted are jointly ground and then compacted to form briquettes.

5. A process according to claim 1, wherein the briquettes so formed have a volume of about 5 to 50 $cm^3$.

* * * * *